US008375596B2

(12) United States Patent
Grunert et al.

(10) Patent No.: US 8,375,596 B2
(45) Date of Patent: Feb. 19, 2013

(54) HOME DEVICE FOR DRYING LAUNDRY COMPRISING A COMPONENT AROUND WHICH PROCESS AIR CAN FLOW

(75) Inventors: Klaus Grunert, Berlin (DE); Werner Nühse, Dallgow-Döberitz (DE); Günter Steffens, Dallgow-Döberitz (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 397 days.

(21) Appl. No.: 12/865,740

(22) PCT Filed: Feb. 20, 2009

(86) PCT No.: PCT/EP2009/052028

§ 371 (c)(1),
(2), (4) Date: Aug. 2, 2010

(87) PCT Pub. No.: WO2009/103785

PCT Pub. Date: Aug. 27, 2009

(65) Prior Publication Data

US 2011/0000097 A1 Jan. 6, 2011

(30) Foreign Application Priority Data

Feb. 22, 2008 (DE) ..... 10 2008 010 517

(51) Int. Cl.
*F26B 13/30* (2006.01)

(52) U.S. Cl. ..... 34/73; 34/601; 34/605; 68/5 R; 510/519; 15/88.4

(58) Field of Classification Search ..... 34/73, 77, 34/79, 80, 90, 91, 595, 601, 605; 68/5 R, 68/17 R, 21; 510/519; 15/88.4
See application file for complete search history.

(56) References Cited

U.S. PATENT DOCUMENTS

| | | | | |
|---|---|---|---|---|
| 3,034,223 | A * | 5/1962 | Lynch | 34/79 |
| 3,363,326 | A * | 1/1968 | Weeks | 34/528 |
| 4,523,387 | A * | 6/1985 | Mahan | 34/261 |
| 5,806,204 | A | 9/1998 | Hoffman et al. | |
| 6,658,760 | B2 * | 12/2003 | Kohlman et al. | 34/311 |
| 7,921,578 | B2 * | 4/2011 | McAllister et al. | 34/597 |
| 2004/0118013 | A1 * | 6/2004 | Kohlman et al. | 34/595 |
| 2007/0051009 | A1 | 3/2007 | Hada et al. | |
| 2009/0031513 | A1 | 2/2009 | Goldberg et al. | |
| 2011/0000097 | A1 * | 1/2011 | Grunert et al. | 34/73 |
| 2011/0126419 | A1 * | 6/2011 | Castillo Fernandez et al. | 34/72 |
| 2012/0036733 | A1 * | 2/2012 | Dehn | 34/282 |

FOREIGN PATENT DOCUMENTS

| | | | |
|---|---|---|---|
| DE | 10330744 | A1 | 2/2005 |
| DE | 202004007070 | U1 | 10/2005 |
| DE | 102006037319 | A1 | 3/2008 |
| JP | 2002-233692 | A | 8/2002 |
| WO | 0164801 | A2 | 9/2001 |
| WO | 2007093461 | A1 | 8/2007 |
| WO | 2007093467 | A1 | 8/2007 |

* cited by examiner

*Primary Examiner* — Stephen M. Gravini
(74) *Attorney, Agent, or Firm* — James F. Howard; Andre Pallapies

(57) ABSTRACT

A domestic appliance for drying laundry having a component around which process air flows. The component has a substrate made of metal and the substrate has a surface facing the process air. The surface carries a coating that prevents adhesion of foreign particles and the coating has a surface energy of no more than 40 mN/m. The surface has a section that is directly impinged by the process air and that is essentially completely covered by the coating. The component has edges in the section covered by the coating and each of the edges is essentially completely covered by the coating.

15 Claims, No Drawings

HOME DEVICE FOR DRYING LAUNDRY COMPRISING A COMPONENT AROUND WHICH PROCESS AIR CAN FLOW

BACKGROUND OF THE INVENTION

The invention relates to a home device (domestic appliance) for drying laundry, comprising a component around which process air can flow, said component having a metal substrate which has a surface facing the process air.

A domestic appliance of this kind, embodied as a tumble dryer for drying laundry, is disclosed by each of patent documents WO 2007/093461 A1, WO 2007/093467 A1 and WO 2007/093468 A1. The appliance is embodied in each case as a tumble dryer for drying damp laundry. It comprises a drying chamber embodied as a rotating drum for accommodating the damp laundry and a process air circuit in which the drying chamber is incorporated and in which a stream of process air circulates. Before entering the drying chamber, the process air is heated by a heat source so that it can absorb moisture from the laundry items being tumbled in the drying chamber. After passing through the drying chamber, the moisture-laden process air is first fed to a fluff filter which collects most of the fine particulate fibers entrained by the process air from the laundry. It then passes to a heat sink where it is cooled. During said cooling, the moisture dissipated by the process air is precipitated from process air as a condensate. The condensate is separated from the process air and stored for subsequent disposal. From the heat sink, the process air is returned to the heat source where it is re-heated and fed back to the drying chamber. Even though the fluff filter catches and retains most of the fluff, the heat sink is significantly contaminated by ultrafine fibers which the fluff filter cannot intercept. The problem is exacerbated in that the fluff is deposited on the heat sink surface facing the process air and adheres thereto to a greater or lesser extent, an effect to which the liquid condensate which collects in the heat sink significantly contributes.

A component for a domestic appliance in the form of an air-to-air heat exchanger emerges from DE 20 2004 007 070 U1. Said heat exchanger consists of tubes made of a plastic material such as polypropylene through which process air contaminated with fluff and moisture is designed to flow. The correspondingly exposed insides of the tubes can be provided with an anti-adhesive or hydrophobic microstructure or coating so that they are less prone to fouling.

If the heat sink is embodied as an air-to-air heat exchanger wherein a flow of cooling air drawn from the appliance environment and returned thereto is guided in an open duct and absorbs the heat from the process air, the air-to-air heat exchanger is generally embodied such that, on completion of a drying process, or after a certain number of drying processes in each case, it can be easily removed from the domestic appliance without using a special tool and cleaned simply by rinsing with water. However, if the heat sink is part of a heat pump in which the heat removed from the process air in the heat sink is pumped to the heat source where it is returned to the process air, it is generally no longer possible to embody the heat sink such that it can be readily removed by an ordinary user. The compressor-type heat pump mentioned in the three documents referred to above connects the heat sink and the heat source in a heat transfer circuit in which a working medium circulates, said working medium being in particular a fluorinated hydrocarbon. The latter flows to the heat sink in liquid form where it is evaporated, for which purpose it absorbs heat from the process air. It is fed in evaporated form to a compressor where it is compressed and conveyed forward to the heat source. Here it is liquefied by discharging heat to the process air. Downstream of the heat source, the working medium is fed to a restrictor which can be a valve, an orifice plate or a capillary, where its internal pressure and its temperature are reduced, and from there back to the heat sink, thereby completing the circuit. In order to ensure long-term operation of this circuit, it must be virtually completely sealed. Conventional practice is to interconnect all the components of this circuit by soldering. This makes it impossible for an ordinary user of the domestic appliance to detach the heat sink from this circuit, as would be required for removing the heat sink from the appliance. The same applies if the heat pump is a thermoelectric heat pump. A thermoelectric heat pump which uses the well-known Peltier effect is according to normal practice a compact unit consisting of two heat exchangers, namely the heat sink and the heat source, between which are mounted the so-called Peltier elements in which the Peltier effect used for pumping the heat is produced by electric current. It is also impossible to remove the heat sink in this heat pump. If in the case of a domestic appliance having a heat pump it is therefore desired to de-fluff the heat sink, other means have to be provided. The three documents mentioned indicate the possibilities of cleaning the heat sink by means of brushes and using additional liquid.

The invention relates not only to domestic appliances for drying laundry in the form of the tumble dryer described, but also to domestic appliances in which laundry can be both washed and dried. Such appliances are known as "combo washer/dryers". It is irrelevant whether or not the heat sink present in such an appliance is a component of a heat pump.

DE 103 30 744 A1 discloses a coating system based on hydrolyzable silanes with high hydrolysis rates. This coating system is designed to lend itself to producing functional coatings having different properties, particularly the property of being easily cleanable, and also to be highly scratch-resistant and suitable for substrates made of glass, ceramic, metal, stone or plastic. A coating produced using a coating system of this kind is based on a so-called polysiloxane resin. A coating system described in the publication cited as "Example 2" is suitable for producing a hydrophobic easy-to-clean coating with very low surface energy, which means that dirt and liquids can stick only very weakly to the coating. As a result the coated surface is not heavily prone to fouling and is easy to clean. However, the lasting adhesion and durability of this coating requires heat treatment at a temperature above 200° C., which limits the applicability of the coating only to correspondingly stressable substrates, in particular metal substrates.

Further examples of easy-to-clean coatings are disclosed in document WO 2001/064 801 A1 which likewise shows coating systems based on polysiloxane resins. In this respect attention should be drawn in particular to the exemplary embodiments designated "Example 2B", "Example 9", "Example 34", "Example 39" and "Example 40". In each case a coating is produced which makes the surface dirt-repellent, which is scratch-resistant and in some cases also capable of withstanding high temperatures. Typical applications in or on a private household are protecting walls from graffiti and also the protective, corrosion-resistant and non-stick coating of cookware, stoves and other equipment.

An object of the present invention is to develop the domestic appliance of the generic type cited in the introduction such that an improvement is achieved in respect of the removal of fluff and other foreign particles from a component, in particular a heat sink, around which process air can flow.

BRIEF SUMMARY OF THE INVENTION

This object is achieved by means of a domestic appliance as claimed in the independent claim. Preferred developments of said domestic appliance are set forth in the dependent claims.

The inventive domestic appliance for drying laundry, which appliance has a component around which process air can flow, said component having a substrate made of metal which has a surface facing the process air, is characterized in that the surface has a coating preventing adhesion of foreign particles, said coating having a surface energy of no more than 40 mN/m.

According to the invention a domestic appliance is thus created in which a component that may be exposed to contamination by foreign particles, particularly fluff, is protected from unwanted adhesion of the foreign particles by a special coating. The invention uses in particular but not exclusively the advantageous properties of the polysiloxane-resin-based coatings that are well-known for other purposes. Such coatings are very thin and at the same time also scratch-resistant, i.e. capable of withstanding high mechanical stresses; they do not significantly impair the in some cases functionally necessary thermal conductivity of the component and are also amenable to cleaning by conventional measures without fear of damage.

According to the invention the coating has a surface energy of no more than 40 millinewtons per meter. Such a surface energy can be measured by depositing droplets of special inks; these are pigmented liquids with specific properties, the behavior of which on the surface under test enables the latter's surface energy to be inferred, the critical criterion in this case being whether a droplet of such an ink runs on the surface or adheres to the surface as a more or less spherical droplet.

It should be noted that the inventive coating with a low surface energy of this kind cannot be achieved merely by coating the surface to be protected with a correspondingly available liquid preparation and more or less simply allowing it to dry. Experience has shown that careful and intensive heat treatment of the coated component is required in order to bring about the necessary orientation of corresponding components of the coating to achieve the desired effect. Said heat treatment also serves to endow the coating with stable adhesion to the surface over the reasonably to be expected lifetime of the component and the domestic appliance, and to make it resistant to the stresses that are to be expected over said lifetime. An estimate of the stressability of the coating over the lifetime can be achieved by exposing the coating to an atmosphere with 100% relative humidity over a period of 1250 hours at a temperature of 70° C. Experience has shown that a corresponding heat treatment of the coating must take place at a temperature of around 250° C., which in any case precludes the use of components made of conventional plastic.

An embodiment of the domestic appliance is preferred in which the coating has a surface energy of no more than 30 millinewtons per meter.

Of particular preference here is a coating which contains a polysiloxane resin, said polysiloxane resin being in particular a polyester-modified methyl phenyl polysiloxane resin. The coating with polysiloxane resin is in particular a coating which is commonly used on cookware as a non-stick coating and, for decorative purposes, on other everyday objects that are subject to high thermal stress. As a matter of further preference, ceramic particles no larger than 50 nanometers are suspended in the coating. In this context, ceramic particles are to be understood as particles from essentially inert oxides, hydroxides and the like; possible candidates are, in particular, silicon dioxide, calcium hydroxide and aluminum oxide as well as derivatives such as boehmite. Likewise of particular preference is a coating having a thickness of between 1 and 50 micrometers, or even more preferably between 1 and 5 micrometers.

It should be noted that the coating, in any case if it is applied by dipping or a process comparable thereto, becomes thicker at edges than on the surface away from the edges because of what is known as the "edge effect". In the case of a thickness of between 1 and 5 um away from the edges, a thickness of between 10 and 20 um may be produced at the edges. This would definitely be an advantage in the present case, since it enables deformed peaks produced during cutting of the components to be completely encoated at such edges, thereby preventing the formation of points of adhesion for droplets and fluff Also preferred is a coating in which a pigment, i.e. a colorant, is suspended, said pigment being selected as a matter of further preference such that it fluoresces in visible light when irradiated with ultraviolet light. This makes it possible to verify, following a coating process, whether the component has been coated as required.

It is also particularly preferred that the surface is essentially completely covered by the coating—in any event completely to the extent that it is covered wherever it is impinged by the process air. This coverage also encompasses, with further preference, edges possibly present in the substrate, such that each edge is also essentially completely covered by the coating.

In this case the surface which carries the coating need not necessarily correspond to the complete surface of the heat sink. The coating can be restricted to a section of the entire surface that is more or less directly impinged by the process air, in particular directly in the process air flow. This section is particularly prone to the accumulation of foreign particles; with a view to economizing on coating material, the coating can be restricted to said area that is particularly at risk. When used in a domestic appliance which is a combo washer/dryer, the section of the heat sink that is to be provided with the coating can be in particular the section extending from a front side directly facing the inflowing process air along the heat sink in the flow direction of the process air over a length of between 5 and 25 mm, in particular approximately 20 mm.

Depending on the application, it may be advantageous to provide corresponding components of the heat sink, e.g. fins and the like, with the coating before they are machined and installed in the heat sink. In some cases this may mean having to accept in particular uncoated cut edges and the like, which, although resulting in reduced effectiveness, may still be favorable in respect of the advantages achieved in terms of simplifying manufacture.

Particularly preferred is a domestic appliance according to the invention in which the coated surface of the component is made from at least one material selected from the group comprising copper, aluminum, iron materials as well as copper solders and silver solders.

Likewise as a matter of particular preference, the domestic appliance according to the invention is embodied as a dryer for laundry, i.e. in particular as a tumble dryer or combo washer/dryer. With particular preference, the component is a heat sink, said heat sink being in particular part of the heat pump. In this context, the component can be non-detachably mounted in the appliance, it being possible to remove undesirable foreign particles such as fluff from the component by a correspondingly provided cleaning device and in particular in an automated manner.

As well as a component which is functionally important in a particular way, such as a heat sink, every component of a generic domestic appliance within the meaning of the invention that is likely to be contaminated with foreign particles can in principle be protected by means of a coating. This therefore inventively includes in particular each component for a process air duct through which the moisture- and fluff-laden process air flows.

DETAILED DESCRIPTION OF EXEMPLARY EMBODIMENTS OF THE PRESENT INVENTION

An exemplary embodiment of the invention will now be explained.

The domestic appliance to be considered below is a tumble dryer having a drying chamber and a closed process air circuit into which the drying chamber is incorporated and in which there is provided a heat pump having a heat sink and a heat source for alternately cooling and heating the circulating process air. The two heat exchangers operating as heat sink and heat source are each embodied as labyrinthine tube systems which are soldered together from individual copper tubes and tube bends and mounted in vertically disposed fins. Said fins are thin aluminum strips and serve to improve heat transfer between the working medium flowing in the tube systems and the process air flowing around the tube systems. To assemble the components, conventional copper or silver solders are used as necessary for hard-soldering copper parts, as well as mounts, screws etc. made of iron or brass materials. The heat sink and the heat source are prefabricated in this form and subsequently installed in the domestic appliance, and the working medium circuit is completed by soldering the heat sink and the heat source to other tubes for the working medium.

Prior to installation in the domestic appliance, the heat exchanger constituting the heat sink is provided with a coating that is resistant to the adhesion of foreign particles. For this purpose it is dipped in a preparation marketed under the name "NP AS 10" by ItN Nanovation AG in Saarbrucken. This is a solution of a polyester-modified methyl phenyl polysiloxane resin combined with a separating substance (which in turn contains nanocrystalline ceramic particles) in an organic solvent. It is actually intended for coatings that are conventionally used on cookware as a non-stick layer or for decorative purposes on other items that are subject to high thermal stress, such as gas cookers. A pigment which fluoresces in visible light when irradiated with ultraviolet light is added to the preparation. The preparation is a slightly viscous and slightly milky liquid which is applied to the heat exchanger by dipping. In the process, said heat exchanger including all edges, in particular all the edges of the fins, is covered by the coating. Complete coverage of the heat exchanger with the coating is verified by applying ultraviolet light to the heat exchanger so that the pigment that was added to the preparation fluoresces in visible light. Verification that all the desired areas of the heat exchanger have been coated with the coating is obtained if all said areas are found to light up in visible light when ultraviolet is applied.

The coating can either extend over the entire heat exchanger or can be limited to the section that is directly impinged by the process air during operation. In this case, however, the coating should cover the corresponding substrate, including any and every edge etc. present, completely and without significant gaps.

For the coating, a thickness of between 1 and 5 micrometers should be aimed for; the thickness of the coating can be adjusted via the proportion of evaporable solvent in the preparation. The thickness of said coating can be measured in particular by scanning electron microscopy. If a thickness within the required range cannot be achieved, a thickness of no more than 50 micrometers may also be acceptable. It should be noted here also that, because of what is known as an "edge effect", the coating becomes thicker anyway at edges than on the surface away from the edges. In the case of a thickness of between 1 and 5 μm away from the edges, a thickness of between 10 and 20 μm may be produced at the edges. This is definitely an advantage in the present case, since it enables deformed peaks produced during cutting of the components to be completely encoated at such edges, thereby preventing the formation of points of adhesion for droplets and fluff.

After coating, the coated heat exchanger is heated in an oven, specifically at 250 degrees centigrade for 30 minutes or at 270 degrees centigrade for 20 minutes. The resulting solid coating adheres firmly to the heat exchanger and is characterized by a very low surface energy of no more than 30 millinewtons per meter; it therefore exhibits excellent resistance to fluff adhesion. Fluff which settles on the coated heat sink during operation of the domestic appliance develops at worst only a very weak bond to the surface of the heat sink and can therefore be removed by simple means, in particular by pouring water over it. This significantly increases in particular the reliability of an automated cleaning system for the heat sink, and also ensures that the heat sink and therefore the domestic appliance as a whole operates stably and unimpaired by unwanted deposits over a long period of time.

The invention claimed is:

1. A domestic appliance for drying laundry, comprising:

a component around which process air flows, the component having a substrate made of metal, the substrate having a surface facing the process air;

wherein the surface carries a coating that prevents adhesion of foreign particles, the coating having a surface energy of no more than 40 mN/m;

wherein the surface has a section that is directly impinged by the process air and that is essentially completely covered by the coating;

wherein the component has edges in the section covered by the coating; and wherein each of the edges is essentially completely covered by the coating.

2. The domestic appliance of claim 1, wherein the coating has a surface energy of no more than 30 mN/m.

3. The domestic appliance of claim 1, wherein the coating contains a polysiloxane resin.

4. The domestic appliance of claim 3, wherein the polysiloxane resin is a polyester-modified methyl phenyl polysiloxane resin.

5. The domestic appliance of claim 3, wherein ceramic particles having a size of no more than 50 nm are suspended in the coating.

6. The domestic appliance of claim 3, wherein the coating has a thickness of between 1 and 50 μm.

7. The domestic appliance of claim 6, wherein the coating has a thickness of between 1 and 5 μm.

8. The domestic appliance of claim 3, wherein a pigment is suspended in the coating.

9. The domestic appliance of claim 8, wherein the pigment fluoresces in visible light when irradiated with ultraviolet light.

10. The domestic appliance of claim 1, wherein the surface is essentially completely covered by the coating.

11. The domestic appliance of claim 1, wherein the coating of the surface of the component includes a material selected from the group consisting of copper, aluminum, iron materials, copper solders, and silver solders.

12. The domestic appliance of claim 1, wherein the domestic appliance is a laundry dryer.

13. The domestic appliance of claim 12, wherein the component is a condenser.

14. The domestic appliance of claim 13, wherein the condenser is part of a heat pump.

15. The domestic appliance of claim 12, wherein the component is non-detachably mounted in the domestic appliance.

* * * * *